United States Patent [19]

Sullivan et al.

[11] 4,145,050

[45] Mar. 20, 1979

[54] DEVICE FOR CATCHING AND THROWING AN AERODYNAMIC DISC

[76] Inventors: Richard A. Sullivan; Debra Sullivan, both of P.O. Box 6; Mark Stumboli, 238 Grove St., all of East Rutherford, N.J. 07073; Kathryn L. Pervin, 708 Sixth St., Lyndhurst, N.J. 07071

[21] Appl. No.: 853,463

[22] Filed: Nov. 21, 1977

[51] Int. Cl.[2] ..... A63B 65/12

[52] U.S. Cl. ..... 273/96 R; 273/106 B; 124/42; 124/5; 273/1 M

[58] Field of Search ..... 273/96 R, 106 B, 162 E, 273/96 B, 96 C, 96 D

[56] References Cited

U.S. PATENT DOCUMENTS

| | | | |
|---|---|---|---|
| 1,994,862 | 3/1935 | Muller | 273/96 R |
| 2,025,995 | 12/1935 | Lerch | 273/96 R |
| 3,314,409 | 4/1967 | Olson | 273/96 R X |
| 3,764,141 | 10/1973 | Robertson et al. | 273/106 B X |
| 3,844,565 | 10/1974 | Gigliotti | 273/162 E X |

FOREIGN PATENT DOCUMENTS

| | | | |
|---|---|---|---|
| 364298 | 11/1922 | Fed. Rep. of Germany | 273/96 R |

*Primary Examiner*—George J. Marlo

*Attorney, Agent, or Firm*—Mel K. Silverman; Richard M. Goldberg

[57] ABSTRACT

A device for catching and throwing a disc-shaped object is provided, comprising a basket for catching the disc-shaped object, the basket including a longitudinal channel at the bottom of the basket and in open communication therewith, the channel having a restraining track therein for releasably securing a disc-shaped object. Attached to the basket and in open communication therewith is a narrow, elongated, arcuate channel, diminishing in height toward its distal end, the channel including a guideway on both of the inner walls of the channel near the upper end thereof for guiding a disc-shaped object having a central axis. The device also includes a handle for grasping the basket to catch and throw a disc-shaped object. The device also includes a magnet at the distal end of the channel for picking up a magnetic disc-shaped object.

8 Claims, 6 Drawing Figures

FIG. 3
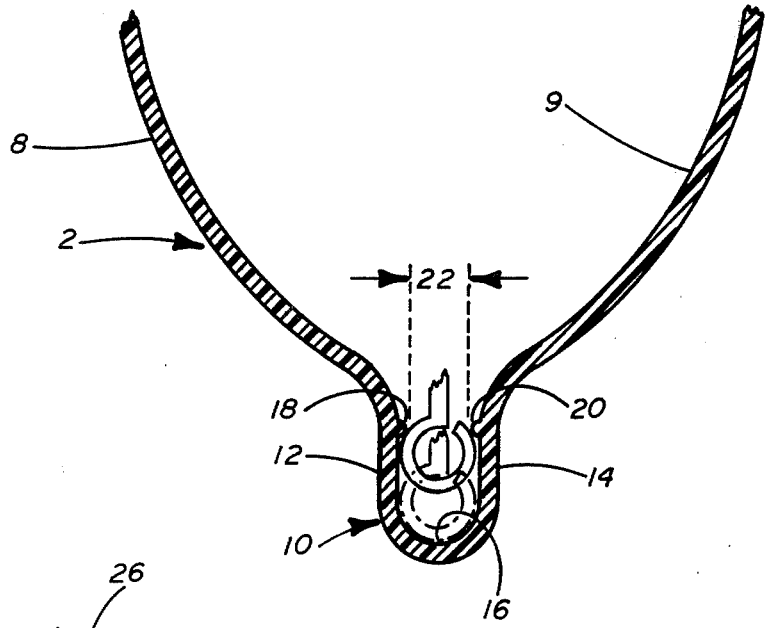
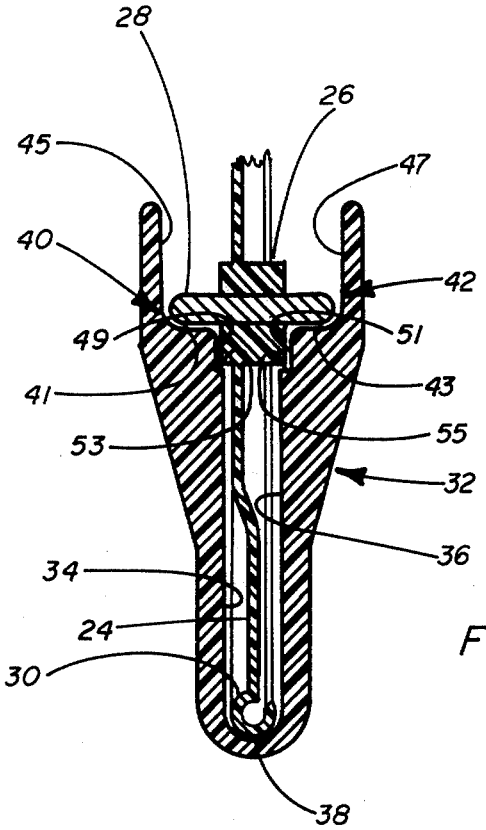
FIG. 4

DEVICE FOR CATCHING AND THROWING AN AERODYNAMIC DISC

BACKGROUND OF THE INVENTION

This invention relates to a device for catching and throwing a disc-shaped object. More particularly, this invention relates to a device for catching and throwing a disc-shaped object having utility as an amusement device, such as in games of catch and the like.

It is well known in the art to provide a device that will throw a disc-shaped object by means of centrifugal force. However, none of these devices can be utilized to catch such a disc-shaped object. For example, one known prior art device discloses a hand trap in which a disc-shaped target is snapped out of a holding means so that it will fly from the guide in the desired direction under the influence of centrifugal force. In this device, a pair of opposing guide walls is utilized to slidably and rotatably restrain the object in the hand trap. Additionally, a flat face of the object is in contact with the flat base plate of the hand trap. In this manner, unnecessary frictional forces are created during the throwing of the object. By utilizing a substantially straight guide means, this device fails to take advantage of the centrifugal force inherent in an appropriately curved guide means.

Another known prior art device in addition to disclosing a similar guide means as the above-cited device, also discloses a funnel means for catching a disc-shaped object. However, this funnel means is unidirectional, e.g., the forward facing funnel must be pointed directly towards the incoming object and any slight variation will result in a failure to catch the disc. This second known device, however, utilizes a spring actuated projector for discharging the disc-shaped object and does not act as a throwing means utilizing centrifugal force.

Still other prior art devices utilize an arcuate track for imparting centrifugal force to a ball. For example, one of these devices discloses a flinging device for balls comprising an arcuate track for catching and throwing balls. However, the same track is utilized to catch and throw the ball, a characteristic of balls which cannot be applied to disc-shaped objects. Additionally, this device discloses a ring of shock-absorbing material for securing the ball within the flinging device to increase the centrifugal force and reliability of flight during the throwing operation. However, again, such a securing means could not be utilized with a disc-shaped object.

SUMMARY OF THE INVENTION

In accordance with the present invention, a device for catching and throwing a disc-shaped object is provided, comprising a basket means for catching the disc-shaped object, the basket means including a longitudinal channel at the bottom of the basket means and in open communication therewith, the channel having a restraining track therein for releasably securing a disc-shaped object. Attached to the basket means and in open communication therewith is a narrow, elongated, arcuate channel, diminishing in height towards its distal end, the channel including a guideway on both of the inner walls of the channel near the upper end thereof for guiding a disc-shaped object having a central axis. The device also includes a handle means for grasping the basket to catch and throw a disc-shaped object.

Accordingly, it is a principal object of the present invention to provide a device for catching and throwing a disc-shaped object which combines the function of catching and throwing a disc-shaped object.

It is a further object of the present invention to provide a device for catching and throwing a disc-shaped object which imparts a maximum centrifugal force to the disc-shaped object during the throwing operation.

It is a still further object of the present invention to provide a device for catching and throwing a disc-shaped object which will catch a disc-shaped object from whatever direction it is thrown.

It is a yet further object of the present invention to provide a device for catching and throwing a disc-shaped object which will automatically and releasably secure the disc-shaped object in the device during the catching operation and hold the disc-shaped object in the device until ready to be thrown.

It is another object of the present invention to provide a device for catching and throwing a disc-shaped object having a substantial amount of its weight at the center of the object for increasing the rotational spin of the object.

It is still another object of the present invention to provide a device for catching and throwing a disc-shaped object in which a magnetic means is provided at the distal end of the device for picking up a partially magnetized disc-shaped object.

It is yet another object of the present invention to provide a device for catching and throwing a disc-shaped object in which the device is compact, inexpensive to manufacture, and durable.

Further objects and advantages will become apparent to those skilled in the art from the ensuing description which proceeds with reference to the accompanying figures.

BRIEF DESCRIPTION OF THE DRAWINGS

FIG. 3 is a side cross-sectional view of FIG. 2 taken along line 3—3.

FIG. 4 is a side cross-sectional view of FIG. 2 taken along line 4—4.

DESCRIPTION OF THE PREFERRED EMBODIMENTS

Figure 1:
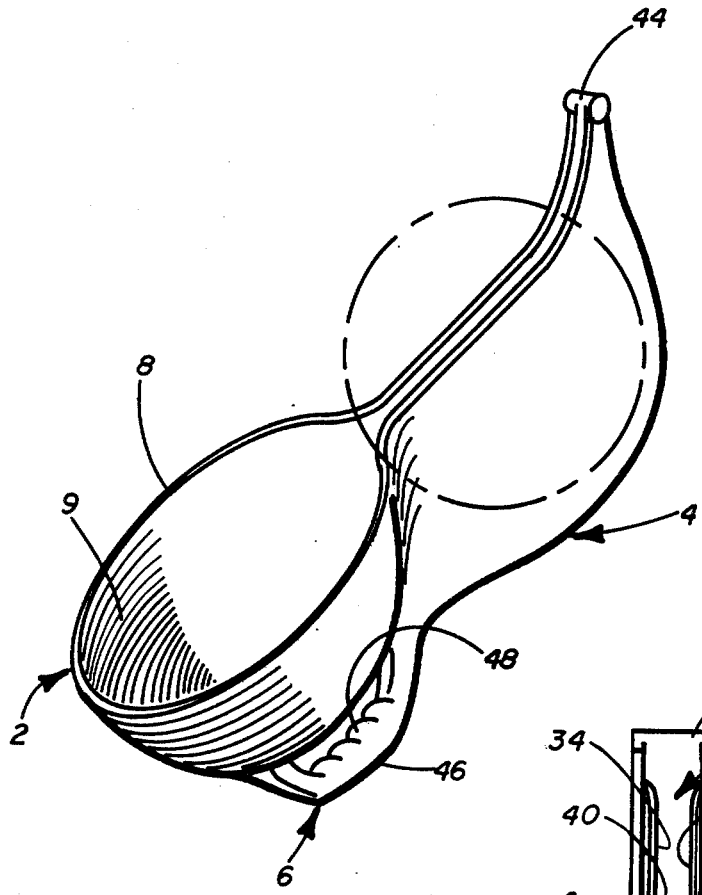
FIG. 1 is a perspective view of the device of the present invention.

Referring to the drawings in detail wherein like numerals indicate like parts and initially to FIG. 1, the device for catching and throwing a disc-shaped object in accordance with the invention is illustrated comprising a basket means 2, a throwing means 4 in open communication with the basket means 2 and attached thereto, and a grasping means 6 attached to basket means 2 for catching and throwing a disc-shaped object 7.

Figure 2:
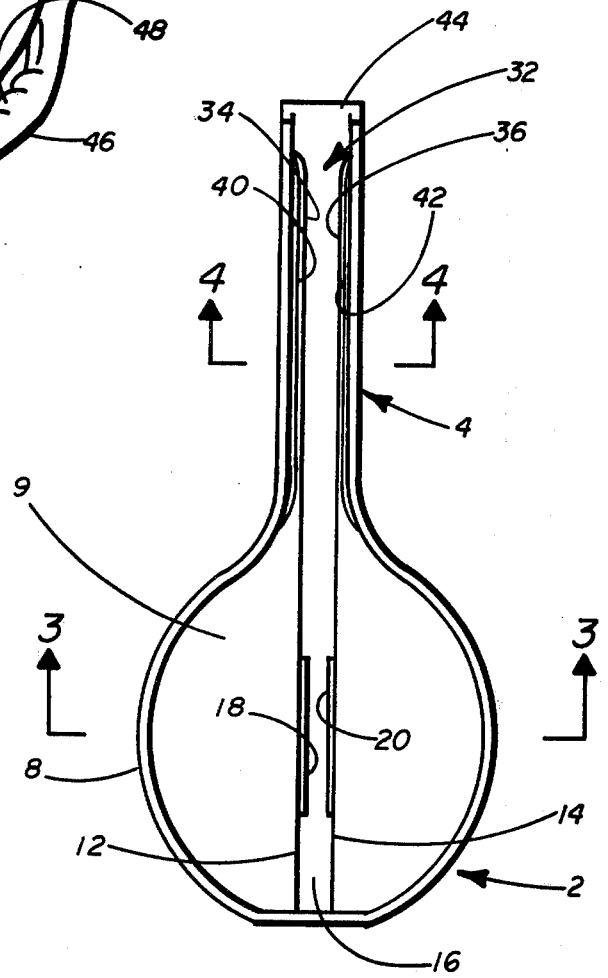
FIG. 2 is a top plan view of the device shown in FIG. 1.

Referring to FIGS. 1 and 2, basket means 2 comprises a basket 8 of an oblong or substantially oval configuration, the smallest diameter at its open end being slightly larger than the diameter of object 7. Basket 8 may be made from any suitable material, preferably a thin, flexible and durable plastic, the inside walls 9 of basket 8 being coated with a lubricous material, to be later discussed.

As shown in FIG. 3, basket 8 gradually tapers in diameter from its upper, open end to its lower end or bottom. At the bottom of basket 8 is a channel 10 in open communication therewith, which runs along the bottom of basket 8 along the direction of its largest diameter, the channel 10 being defined by side walls 12 and 14 and lower track or floor 16. Referring to FIGS. 2 and 3, along a center section of channel 10 at its upper end and on the inside of walls 12 and 14 is a restraining track 17, comprising guide rails 18 and 20, running parallel with lower track 16. The guide rails 18 and 20 are directly across from one another and define a space 22 therebetween. Thus, a partial enclosure is provided in channel 10 defined by side walls 12 and 14, lower track 16, and guide rails 18 and 20.

Figure 5:
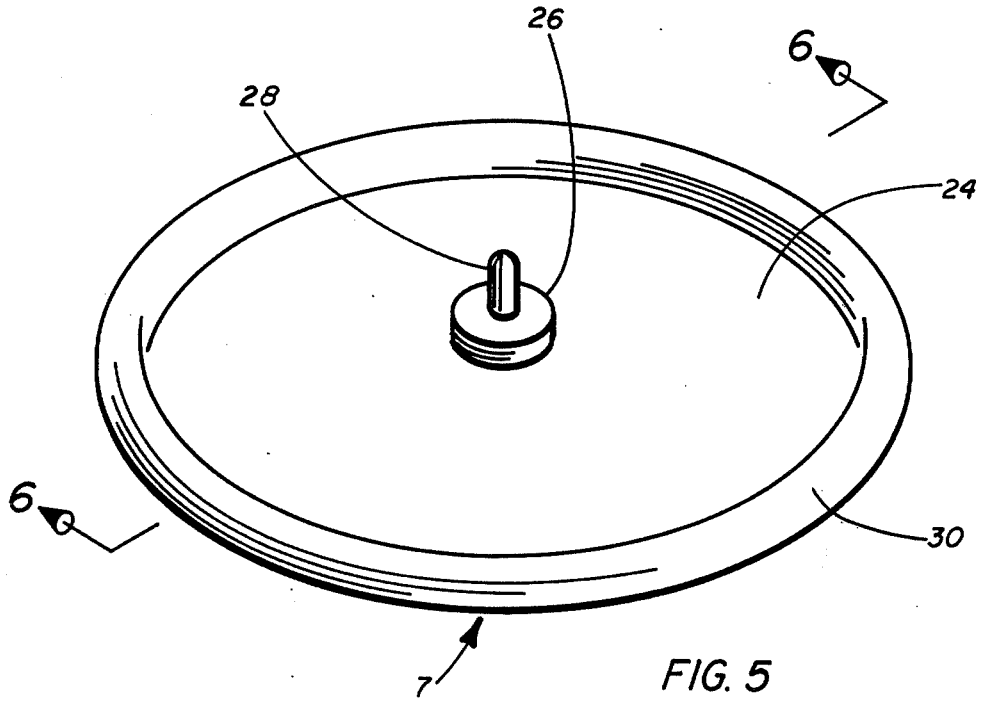
FIG. 5 is a perspective view of a disc-shaped object that may be utilized with the present invention.
Figure 6:
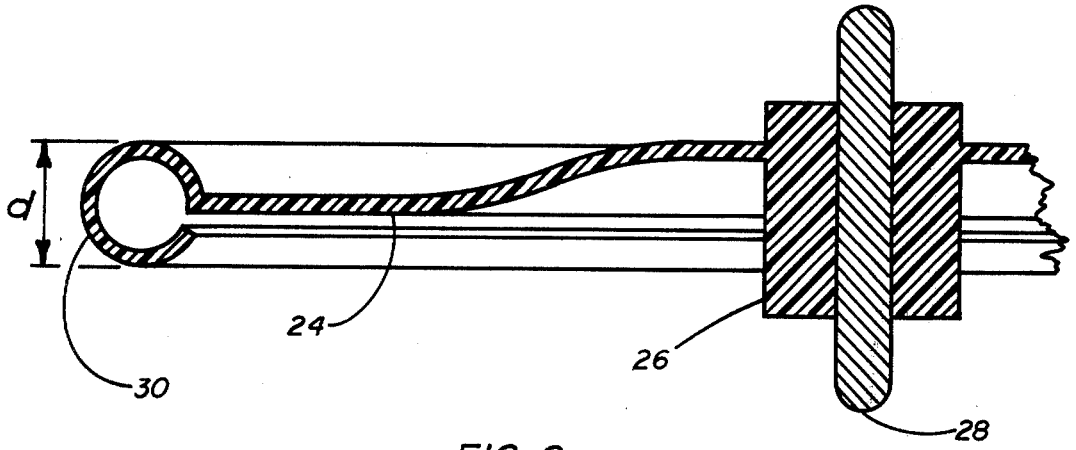
FIG. 6 is a partial side cross-sectional view taken along line 6—6 of FIG. 5.

Referring to FIGS. 5 and 6, a particular disc-shaped object 7 disclosed in U.S. patent application Ser. No. 842,072 by R. Sullivan is illustrated which is useful in accordance with the device of the present invention, comprising a substantially planar or slightly curved circular disc 24. Disposed within the center of disc 24 is a central core 26 having a central axis 28 located therein, central axis 28 being substantially perpendicular to disc 24. Axis 28 is of a rod-like, cylindrical configuration and provides a substantial amount of the weight of object 7. Object 7 also includes a toroidal or donut-shaped outer rim 30 attached to the periphery of disc 24, rim 30 having an outer rim diameter d slightly larger than space 22 defined by guide rails 18 and 20. As shown in FIG. 6, toroidal rim 30 is partially open at any end cross-section, to be later discussed. Preferably, along the outer periphery of rim 30 is a friction gripping surface. It is to be noted, however, that the present invention encompasses the utilization of any suitable disc-shaped object and is not limited to the above-described disc-shaped object. For example, a disc-shaped object under the trademark "Frisbee" may be utilized.

As shown in FIG. 3, when object 7, having a diameter slightly less than the smallest diameter of the open end of basket 8, enters basket 8 even slightly askew, the oblong configuration of basket 8 in combination with the lubricous inner surface 9 thereof and the force of thrown disc-shaped object 7, will force object 7 into planar alignment with channel 10. These above-cited elements will also force a section of outer toroidal rim 30 of object 7, due to the flexible nature of the partially open end section of toroidal rim 30 and of the channel 10, through guide rails 18 and 20 into channel 10 to releasably secure disc-shaped object 7 in basket means 2 during the catching operation, as shown in FIG. 3.

Referring to FIGS. 1 and 2, a throwing means 4 is attached to basket means 2 for throwing a disc-shaped object 7. Throwing means 4 comprises a narrow, elongated, arcuate channel 32 in open communication with basket means 2 and more specifically, a continuation of channel 10 of basket means 2.

Referring to FIGS. 1 and 4, channel means 32 is defined by side walls 34 and 36 and track 38, walls 34 and 36 being of equal height and gradually diminishing in an arcuate manner until they vanish completely at the distal end of throwing means 4. Track 38 preferably includes a friction gripping surface which engages a corresponding friction gripping surface on rim 30 of disc-shaped object 7 to enhance the spinning action and consequent throwing distance of object 7 during the throwing operation. Track 38 further flares outwardly in an arcuate manner at the distal end of channel 32 to enhance the centrifugal force imparted to disc-shaped object 7 during its throwing operation.

Referring again to FIG. 4, guideways 40 and 42 are provided at the upper end of side walls 34 and 36, respectively, of channel 32, guideways 40 and 42 being of equal height from track 38 and running parallel to the upper ends of side walls 34 and 36 of channel 32. Guideways 40 and 42 extend outwardly from the center of channel 32 and are defined by arcuate tracks 41 and 43 and vertical sidewalls 45 and 47, respectively. In this manner, when object 7 initially begins to traverse channel 32 the outer surface of toroidal rim 30 of disc-shaped object 7 will roll along, in frictional contact with, track 38, the friction generated thereby of sufficient magnitude as to increase the spin of object 7. Additionally, central axis 26 of object 7 will be slightly above and out of contact with arcuate tracks 41 and 43 of channel 32. Upon reaching a certain centrifugal force, disc 24 of disc-shaped object 7 will deform slightly, increasing the frictional engagement between track 38 and toroidal rim 30 of object 7. Also, the deformation of disc 24 will cause central axis 28 of disc-shaped object 7 to contact arcuate tracks 41 and 43 such that guideways 40 and 42 will guide object 7 in a path substantially co-planar with sidewalls 34 and 36 with no reduction in the frictional engagement between track 38 and object 7. It is to be noted, however, the guideways 40 and 42 may be removed such that disc-shaped object 7 is guided by sidewalls 34 and 36 of channel 32.

Referring to FIG. 4, stepped indentations 49 and 51 may be disposed between guideways 40 and 42 and side walls 34 and 36, the distance between the stepped indentations 49 and 51 being slightly greater than the height of central core 26 of disc-shaped object 7, previously discussed. Additionally, horizontal surfaces 53 and 55 of stepped indentations 49 and 51 are disposed below central core 26 when disc-shaped object 7 rides in channel 32. In this manner, stepped indentations 49 and 51 act to guide disc-shaped object 7 in channel means 32. It is to be noted, however, that the inclusion of stepped indentations 49 and 51 is optional and that the present invention is only limited to the scope of the invention as defined by the claims.

Referring to FIG. 1, a magnet 44 is attached to the distal end of throwing means 4 so as not to interfere with the trajectory of object 7 in channel 32 during the throwing operation. By providing a magnetized or polar material in one part of disc-shaped object 7, e.g., central axis 28, the present invention can be utilized to pick up a disc-shaped object 7 from the ground without requiring the user or player to bend or stoop. Also, a grasping means 6 is attached to basket means 2 for catching and throwing a disc-shaped object 7. Grasping means 6 comprises a handle 46 having finger indentations 48 for easily grasping handle 46.

In operation, when a disc-shaped object 7 as described above is thrown to a person holding the present invention by handle 46, that person angles basket 8 in the general direction of the thrown object 7 to catch object 7 in basket 8. When object 7 enters basket 8 slightly askew, it is forced to straighten along the direction of channel 10 and the force of object 7 as thrown will allow the toroidal rim 30 and sidewalls 12 and 14 of channel 10 to deform slightly, to allow toroidal rim 30 to pass through guide rails 18 and 20 and to enter channel 10, thus releasably securing disc-shaped object 7 in basket means 2. In this manner, the user of the present invention can run with the present invention without having the disc-shaped object 7 released from the basket means 2 until the throwing operation.

When the user desires to throw the disc-shaped object by means of the present invention, he grasps handle 46 with the distal end of the throwing means 4 away from him and moves his throwing arm in the same manner that one might throw a baseball. In this manner, when sufficient centrifugal force is developed, object 7 will be formed through guide rails 18 and 20 out of channel 10 of basket 2. Object 7 will be forced into channel 32 of throwing means 4 where it will ride therein as previously described. Thus, only one arm is needed for the catching and throwing operation and the user is not required to place object 7 in throwing means 2 with his free arm, since this is automatically done in the normal operation of the present invention. When disc-shaped object 7 approaches the distal end of throwing means 4, the centrifugal force of the throwing operation will force object 7 to be projected radially outward.

By utilizing this invention, the disc-shaped object can be caught from whatever direction thrown, and releasably secured in the present invention until ready to be thrown. Also, greater distance is obtained than can be normally obtained by the normal throwing of a "Frisbee-type" object. This latter result is obtained from the initial restraint of object 7 by guide rails 18 and 20 of channel 10 until a sufficient force is obtained to release object 7 from channel 10, thereby providing a greater inertial force to project disc-shaped object 7. Additionally, the curvature of throwing means 4 enhances the centrifugal force utilized to project disc-shaped object 7 into the air. These same characteristics also result in greater accuracy than that obtained by the normal use of a "Frisbee".

It is to be understood that the invention is not limited to the illustrations described and shown herein, which are deemed to be merely illustrative of the best modes of carrying out the invention, and which are suitable of modification of form, size, arrangement of parts, and details of operation. The invention rather is intended to encompass all such modifications which are within the spirit and scope as defined by the claims.

What is claimed is:

1. A device for catching and throwing a disc-shaped object comprising:

a basket means for catching said disc-shaped object;

a means attached to said basket means for throwing said disc-shaped object, said throwing means comprising a narrow, elongated, arcuate channel open at one end thereof to said basket means, said channel diminishing in height toward its distal end, said channel in said throwing means extending across said basket means along the bottom thereof from the juncture of said basket means and said throwing means to the opposite side of said basket means, said channel in said basket means being in open communication with said basket means at the upper end of said channel; and a grasping means attached to said basket means for catching and throwing a disc-shaped object.

2. The device of claim 1 wherein said basket means is oblong in configuration and gradually tapers in diameter from its upper, open end to its bottom.

3. The device of claim 1 wherein said channel in said basket means includes a restraining track for securing said disc-shaped object in said basket means, said restraining track comprising two spaced guide rails on the inner walls of said channel in said basket means.

4. The device of claim 1 wherein said channel in said throwing means includes a guideway on the inner walls of said channel near the upper end thereof for guiding a disc-shaped object having a central axis extending from both sides thereof during the throwing operation.

5. The device of claim 1 wherein said grasping means includes a handle attached to the underside of said basket means.

6. The device of claim 1 wherein said distal end of said channel in said throwing means includes a magnetic means for picking up a disc-shaped object having a magnetic or polar means without requiring the user to bend or stoop.

7. A device for catching and throwing a disc-shaped object, comprising:

an oblong basket means for catching said disc-shaped object, said basket means gradually tapering in diameter from its upper, open end to its bottom;

a means attached to said basket means for throwing said disc-shaped object, said throwing means comprising a narrow, elongated, arcuate channel open at one end thereof to said basket means, said channel diminishing in height toward its distal end, said channel in said throwing means extending across said basket means along the bottom thereof from the juncture of said basket means and said throwing means to the opposite side of said basket means, said channel in said basket means being in open communication with said basket means at the upper end of said channel, said channel in said basket means including a restraining track for securing said disc-shaped object in said basket means, said restraining track comprising two spaced guiderails on the inner walls of said channel in said basket means, and said channel including a guideway on the inner walls of said channel near the upper end thereof; and a grasping means attached to said basket means for catching and throwing a disc-shaped object.

8. The device of claim 7 wherein said distal end of said channel in said throwing means includes a magnetic means for picking up a disc-shaped object having a magnetic or polar means without requiring the user to bend or stoop.

* * * * *